US008500613B2

(12) United States Patent
Eddy

(10) Patent No.: US 8,500,613 B2
(45) Date of Patent: Aug. 6, 2013

(54) PORTABLE LEG EXERCISER AND MOBILITY ENHANCEMENT SYSTEM

(71) Applicant: Malcolm Eddy, Naples, FL (US)

(72) Inventor: Malcolm Eddy, Naples, FL (US)

(73) Assignee: Ole! LLC, Garland, TX (US)

( * ) Notice: Subject to any disclaimer, the term of this patent is extended or adjusted under 35 U.S.C. 154(b) by 0 days.

(21) Appl. No.: 13/660,906

(22) Filed: Oct. 25, 2012

(65) Prior Publication Data

US 2013/0045843 A1 Feb. 21, 2013

Related U.S. Application Data

(62) Division of application No. 12/847,970, filed on Jul. 3, 2010, now Pat. No. 8,376,919.

(60) Provisional application No. 61/273,369, filed on Aug. 4, 2009.

(51) Int. Cl.
*A63B 21/00* (2006.01)

(52) U.S. Cl.
USPC ..... 482/131; 482/79; 482/907

(58) Field of Classification Search
USPC ..... 482/79, 91, 131, 907
See application file for complete search history.

(56) References Cited

U.S. PATENT DOCUMENTS

| | | | | |
|---|---|---|---|---|
| 5,253,639 | A | 10/1993 | Johnston | |
| 5,267,926 | A | 12/1993 | Schaefer | |
| 5,713,821 | A | 2/1998 | Nissen | |
| 5,863,280 | A | 1/1999 | Wang | |
| 6,159,133 | A | 12/2000 | Shugg | |
| 6,887,187 | B1 * | 5/2005 | Renz | 482/57 |
| 7,361,127 | B2 | 4/2008 | Tremayne | |
| 7,635,323 | B2 * | 12/2009 | Halbridge | 482/130 |
| 8,303,472 | B2 * | 11/2012 | Bowser | 482/121 |

* cited by examiner

*Primary Examiner* — Glenn Richman
(74) *Attorney, Agent, or Firm* — Kirby B. Drake; Klemchuk Kubasta LLP

(57) ABSTRACT

A system (100) and method (400, 500) to exercise the leg and enhance mobility after a variety of injuries or surgery is disclosed. The system could include a chair leg anchor (104), a leg wrap (102), a stationary pulley (110) secured to the chair leg anchor, a movable pulley (108) secured to the leg wrap, a rope (106), and a handle (112). The rope could be threaded from a first end secured to the chair leg anchor, through the movable pulley, through the stationary pulley, and to a second end secured to the handle.

4 Claims, 7 Drawing Sheets

PORTABLE LEG EXERCISER AND MOBILITY ENHANCEMENT SYSTEM

CROSS REFERENCE TO RELATED APPLICATIONS

This application is a divisional of U.S. patent application Ser. No. 12/847,970, filed Jul. 30, 2010 entitled "Portable Leg Exerciser and Mobility Enhancement System" which claims benefit under 35 U.S.C. §119(e) of U.S. Provisional Patent Application Ser. No. 61/273,369 filed on Aug. 4, 2009 in the United States Patent and Trademark Office entitled "Orthopedic leg exerciser," both of which are incorporated by reference in their entirety as if fully disclosed herein.

TECHNICAL FIELD

The disclosure relates generally to exercise and mobility enhancement methods and systems and, in particular, to portable leg exerciser and mobility enhancement systems that require minimal professional assistance.

BACKGROUND

Immediate exercise of the knee is necessary following a variety of injuries and many surgical procedures, including total knee replacement and anterior cruciate ligament (ACL) repair, to restore full range of motion. For effective rehabilitation, both flexion and extension mobility exercises are recommended. Although the specific regimen can vary depending on the circumstances, a typical regimen for the first three to four weeks of rehabilitation is to perform both flexion and extension exercises three times a day for ten minutes each. Over time, such rehabilitation generally improves range of motion and strength of the users knee(s). These exercises are generally limited to being performed either at a physical therapist's office or by renting the equipment and having a physical therapist come to the user's home. The reason for such limitations is that bulky, expensive and complicated equipment is typically required to perform such exercise. Moreover, both the equipment and the proper use of the equipment typically require significant guidance and supervision.

What is needed is a portable, inexpensive and simple system and method to exercise the leg (and thereby enhance mobility) with little, if any on-site professional assistance required.

SUMMARY

Embodiments of the present disclosure generally provide a portable exercise and mobility enhancement system for the leg.

In one embodiment, the present disclosure could provide a portable leg exerciser and mobility enhancement system. The system could include a leg wrap having a movable pulley coupled therewith, a chair leg anchor having a stationary pulley coupled therewith. The system could further include a rope having a secured end coupled to the chair leg anchor and a free end threaded from the secured end through the movable pulley and through the stationary pulley. The system could further include a handle coupled to the free end of the rope. The leg wrap could further include a leg stirrup and the chair leg anchor could further include a chair leg stirrup.

In another embodiment, the system could be adapted for leg extension by adapting the leg wrap to be removably fastened to a user's leg on or near the user's knee, adapting the chair leg anchor to be removably fastened to a rear leg of a chair, and adapting the rope to apply downward pressure to the user's leg when the user's leg is placed on an elevated surface and the rope is pulled. The system could be further adapted to removably fasten the leg wrap to a selected side of the user and to removably fasten the chair leg anchor to a rear leg of the chair on a side of the chair corresponding to the selected side of the user.

In another embodiment, the system could be adapted for leg flexion by adapting the leg wrap to be removably fastened to a user's leg on, or near the user's ankle, adapting the chair leg anchor to be removably fastened to a front leg of a chair, and adapting the rope to apply rearward pressure to the user's leg when the rope is pulled. The system could be further adapted to removably fasten the leg wrap to a selected side of the user and to removably fasten the chair leg anchor to a front leg of the chair on a side of the chair corresponding to the selected side of the user.

In one embodiment, the present disclosure could provide a method of using a portable leg exerciser and mobility enhancement system as described above. The method could be used for leg extension. Alternatively, the method could be used for leg flexion.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The present disclosure generally provides a portable, inexpensive and simple system and method of exercising the leg to enhance mobility and to promote rehabilitation and strength training. One embodiment of the present disclosure could include a leg wrap component coupled with a chair leg anchor component, and a rope and pulley system.

Figure 1:
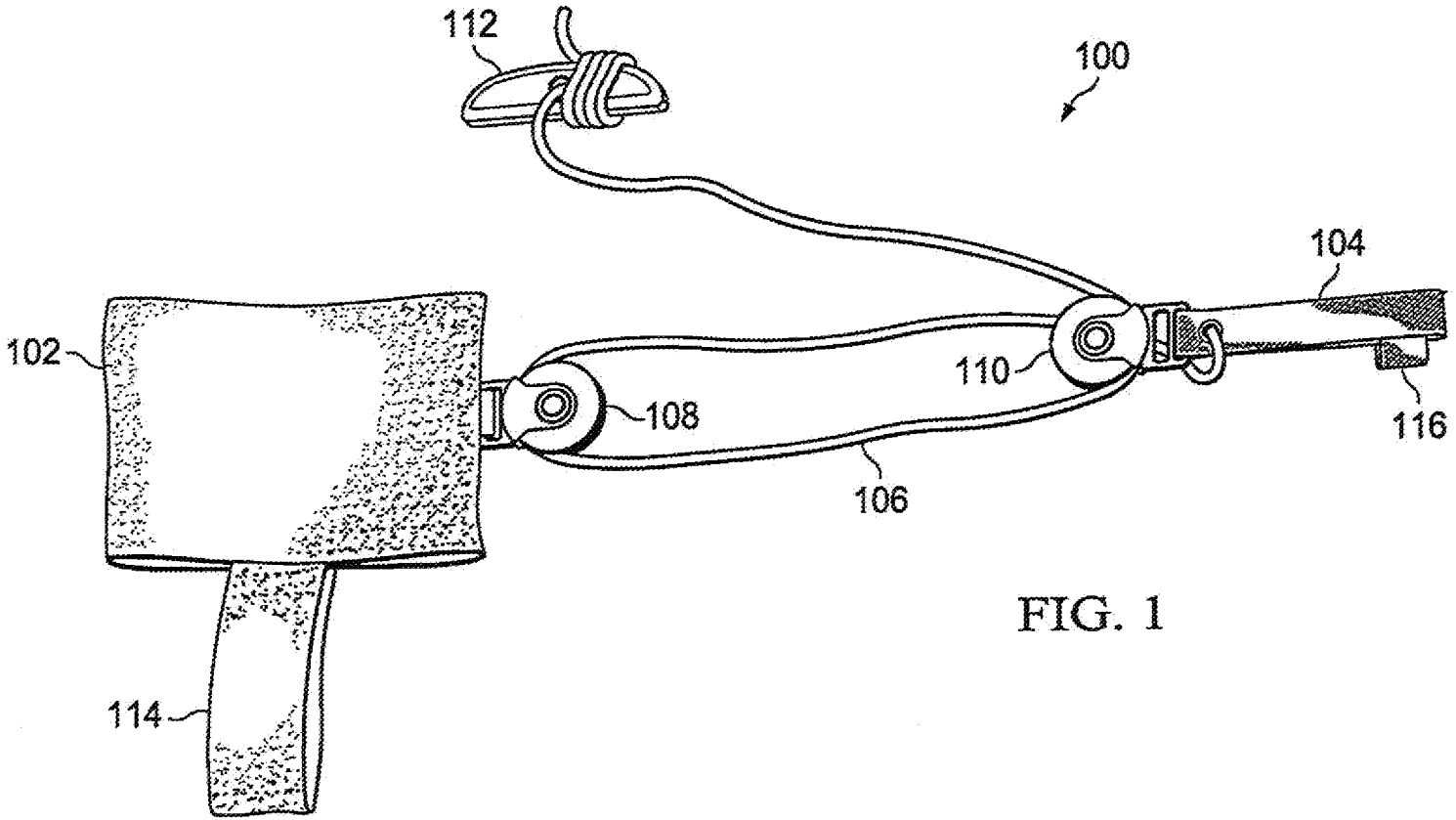
FIG. 1 is an exemplary illustration of a portable leg exerciser and mobility enhancement system in accordance with one embodiment of the present disclosure.

FIG. 1 generally illustrates a leg exerciser and mobility enhancement system 100 according to one embodiment of the present disclosure. It should be understood that system 100 shown in FIG. 1 is for illustrative purposes only and that any other suitable system or subsystem could be used in conjunction with or in lieu of system 100 according to one embodiment of the present disclosure.

System 100 could generally include leg wrap 102, chair leg anchor 104, rope 106, movable pulley 108, stationary pulley 110, handle 112, leg stirrup 114 and chair leg stirrup 116 according to one embodiment of the present disclosure.

In one embodiment, leg wrap 102 could be coupled to chair leg anchor 104 through rope 106, which could be routed forward by movable pulley 108 and backward by stationary pulley 110. Movable pulley 108 could be connected at an end to leg wrap 102 and stationary pulley 110 could be connected at an end to chair leg anchor 104. System 100 could be controlled by the user through handle 112, which could be attached to an end of rope 106. System 100 could also include leg stirrup 114 which could be connected to leg wrap 102 and chair leg stirrup 116 which could be connected to chair leg anchor 104.

Leg wrap 102 could be used to support and protect the leg, while the leg is moved forward and backward by system 100 according to one embodiment of the present disclosure. Leg wrap 102 could be securely fastened, either directly above the knee during extension exercise or directly above the ankle during flexion exercise. Leg wrap 102 could be securely fastened by a snap buckle, snap lock buckle, side snap buckle, buckle, button, snap-button, adhesive, tape, glue, temporary adhesive, spray adhesive, heat sensitive adhesive, hook-and-loop fastener, removable adhesive tab, peel-and-stick material, clay, putty, sticky material, staple, retaining structure, clip, screw, pin, other suitable adhesive or retaining device, or any combination thereof.

In one embodiment, leg wrap 102 could be used in conjunction with leg stirrup 114. Leg stirrup 114 could be positioned directly below the knee during extension exercise or under the foot during flexion exercise to ensure that leg wrap 102 remains positioned appropriately to provide maximum support to the leg. Both leg wrap 102 and leg stirrup 114 could be made of terry cloth, towel-like material, cloth, canvas, silk, chiffon, polyester, cotton, flax, wool, ramie, nylon, denim, leather, rayon, bamboo, rope, jute, hemp, sisal, fiber, rope-like material, twine, polypropylene, polyurethane, polyethylene, polyvinyl chloride (PVC), silicon, bungee cord material, polytetrafluoroethylene (PTFE), high-gloss polyester, synthetic rubber, natural rubber, plastic, polymer, natural fiber, synthetic fiber, other suitable material, or any combination thereof.

Chair leg anchor 104 could be used to anchor and hold the device stationary at one end according to one embodiment of the present disclosure. Chair leg anchor 104 could be anchored around a chair leg by lifting the chair leg and allowing the looped material to completely fit around the chair leg. Chair leg anchor 104 could also be anchored around a chair leg through the use of a snap buckle, snap lock buckle, side snap buckle, buckle, button, snap-button, adhesive, tape, glue, temporary adhesive, spray adhesive, heat sensitive adhesive, book-and-loop fastener, removable adhesive tab, peel-and-stick material, clay, putty, sticky material, staple, retaining structure, clip, screw, pin, other suitable adhesive or retaining device, or any combination thereof. It should be understood that a chair could be any structure the user could sit on, including a four-legged chair, step stool, bar stool, butterfly chair, bench, table, chaise lounge, folding chair, office chair, other suitable structure, or any combination thereof.

In one embodiment, chair leg anchor 104 could be used in conjunction with chair leg stirrup 116. Chair leg stirrup 116 could be positioned under the appropriate chair leg to ensure that chair leg anchor 104 remains positioned at the bottom of the appropriate chair. Both chair leg anchor 104 and chair leg stirrup 116 could be made of terry cloth, towel-like material, cloth, canvas, silk, chiffon, polyester, cotton, flax, wool, ramie, nylon, denim, leather, rayon, bamboo, rope, jute, hemp, sisal, fiber, rope-like material, twine, polypropylene, polyurethane, polyethylene, polyvinyl chloride (PVC), silicon, bungee cord material, polytetrafluoroethylene (PTFE), high-gloss polyester, synthetic rubber, natural rubber, plastic, polymer, natural fiber, synthetic fiber, other suitable material, or any combination thereof.

Rope 106 could be used to engage system 100, thereby causing movement of the leg that is fixed in leg wrap 102 according to one embodiment of the present disclosure. System 100 is engaged by rope 106 when the user pulls handle 112, which could be attached at an end of rope 106. As handle 112 is pulled, rope 106 in system 100 is also pulled and the distance between movable pulley 108 and stationary pulley 110 is shortened, thereby causing controlled movement of the leg that is fixed in leg wrap 102. Rope 106 could be made of nylon, rope, jute, hemp, sisal, leather, fiber, rope-like material, twine, cloth, canvas, polypropylene, polyurethane, polyethylene, polyvinyl chloride (PVC), silicon, bungee cord material, polytetrafluoroethylene (PTFE), polyester, high-gloss polyester, synthetic rubber, natural rubber, plastic, polymer, natural fiber, synthetic fiber, other suitable material, or any combination thereof.

In one embodiment, rope 106 could be connected or otherwise coupled to handle 112 in any suitable manner including tying rope 106 around handle 112, having male and female coupling adapters, having a ball and socket attachment, having a brass ring and chain attachment, a clip or pin attachment, or using other suitable coupling materials, or any combination thereof. Handle 112 could be made of hard plastic, soft plastic, wood, brass, steel, silicon, synthetic rubber, natural rubber, polymer, leather, other suitable material, or any combination thereof. Handle 112 could be of any shape, and could be molded to fit ergonomically in the user's hand. If desired, handle 112 could be customized and embellished with different colors, stickers, removable stickers, paints, stencils, erasable markers, chalks, designs, patterns, images, wood grain patterns, novelty items, ornamental items, other decorative materials, or any combination thereof.

Movable pulley 108 and stationary pulley 110 could be rope and pulley systems that include a wheel and rope 106 to engage system 100 and cause the leg to move forward in extension exercise or backward in flexion exercise, according to one embodiment of the present disclosure.

In one embodiment, movable pulley 108 could be connected at an end to leg wrap 102 through the use of rope, rope-like material, bungee cord material, cloth, canvas, leather, nylon, fiber, twine, snap buckle, snap lock buckle, side snap buckle, buckle, button, snap-button, adhesive, tape, glue, temporary adhesive, spray adhesive, heat sensitive adhesive, hook-and-loop fastener, removable adhesive tab, peel-and-stick material, clay, putty, sticky material, staple, retaining structure, clip, screw, pin, other suitable adhesive or retaining device, or any combination thereof.

In one embodiment, stationary pulley 110 could be connected at an end to chair leg anchor 104 through the use of rope, rope-like material, bungee cord material, cloth, canvas, leather, nylon, fiber, twine, snap buckle, snap lock buckle, side snap buckle, buckle, button, snap-button, adhesive, tape, glue, temporary adhesive, spray adhesive, heat sensitive adhesive, hook-and-loop fastener, removable adhesive tab, peel-and-stick material, clay, putty, sticky material, staple, retaining structure, clip, screw, pin, other suitable adhesive or retaining device, or any combination thereof.

System 100 could be used to prevent muscle loss by rebuilding the strength of different muscle groups and preventing stiffness of the knee. Knee extension exercises promote muscle activity and strengthen the quadriceps muscle group. Knee flexion exercises promote muscle activity and strengthen the hamstring muscle group. Coupling knee extension exercises with knee flexion exercise is important to achieve maximum range of motion following injury or surgery to the knee or ACL. Both extension and flexion exercises could be done using the portable leg exerciser and mobility enhancement system at the onset for ten minutes, three times a day. After the first three to four weeks, the user can increase the amount of time spent utilizing the system. As the user's range of motion increases, the user can adjust the tension of the system by adjusting rope 106 and handle 112. The user can also add a weight or bearing to the system to achieve the desired tension in order to further increase range of motion.

System 100 is portable and can be used at home, work, during travel, or at any other suitable location. System 100 could be used by a person of any size by adjusting the length of rope 106 and the fit of leg wrap 102, as necessary.

Figure 2A:
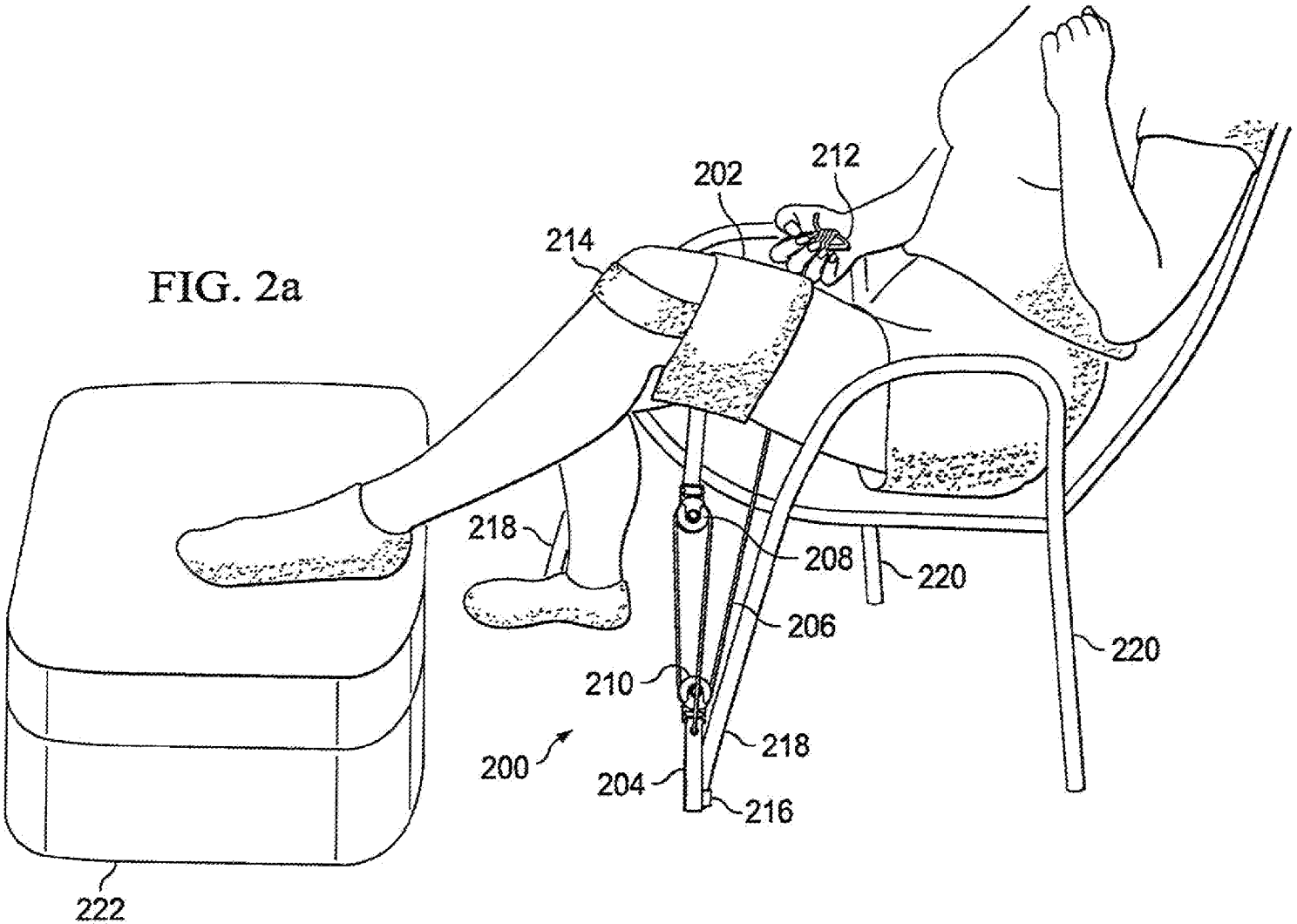
FIG. 2*a* is an exemplary illustration of the portable leg exerciser and mobility enhancement system shown in FIG. 1 employed to perform extension exercise in accordance with one embodiment of the present disclosure, wherein such system is in the disengaged position.

FIG. 2*a* is an exemplary illustration of portable leg exerciser and mobility enhancement system 200 employed to perform extension exercise according to one embodiment of the present disclosure, wherein the system is in the disengaged position. It should be understood that system 200 shown in FIG. 2*a* is for illustrative purposes only and that any other suitable system or subsystem could be used in conjunction with or in lieu of system 200 according to one embodiment of the present disclosure.

System 200 could include leg wrap 202, chair leg anchor 204, and rope 206. In one embodiment, system 200 could be similar to system 100 shown in and described in conjunction with the description accompanying FIG. 1 above (with like parts having similar numbers).

in one embodiment, chair leg anchor 204 could generally be configured to be placed under one of the front legs 218 of a chair corresponding to the leg that needs to be exercised. Leg wrap 202 could be configured to securely fit directly above the appropriate knee, while the leg is bent at the knee and the foot is rested on an elevated surface 222. Rope 206 could be pulled until there is slight tension in the system to create the disengaged position of extension exercise.

Figure 2B:
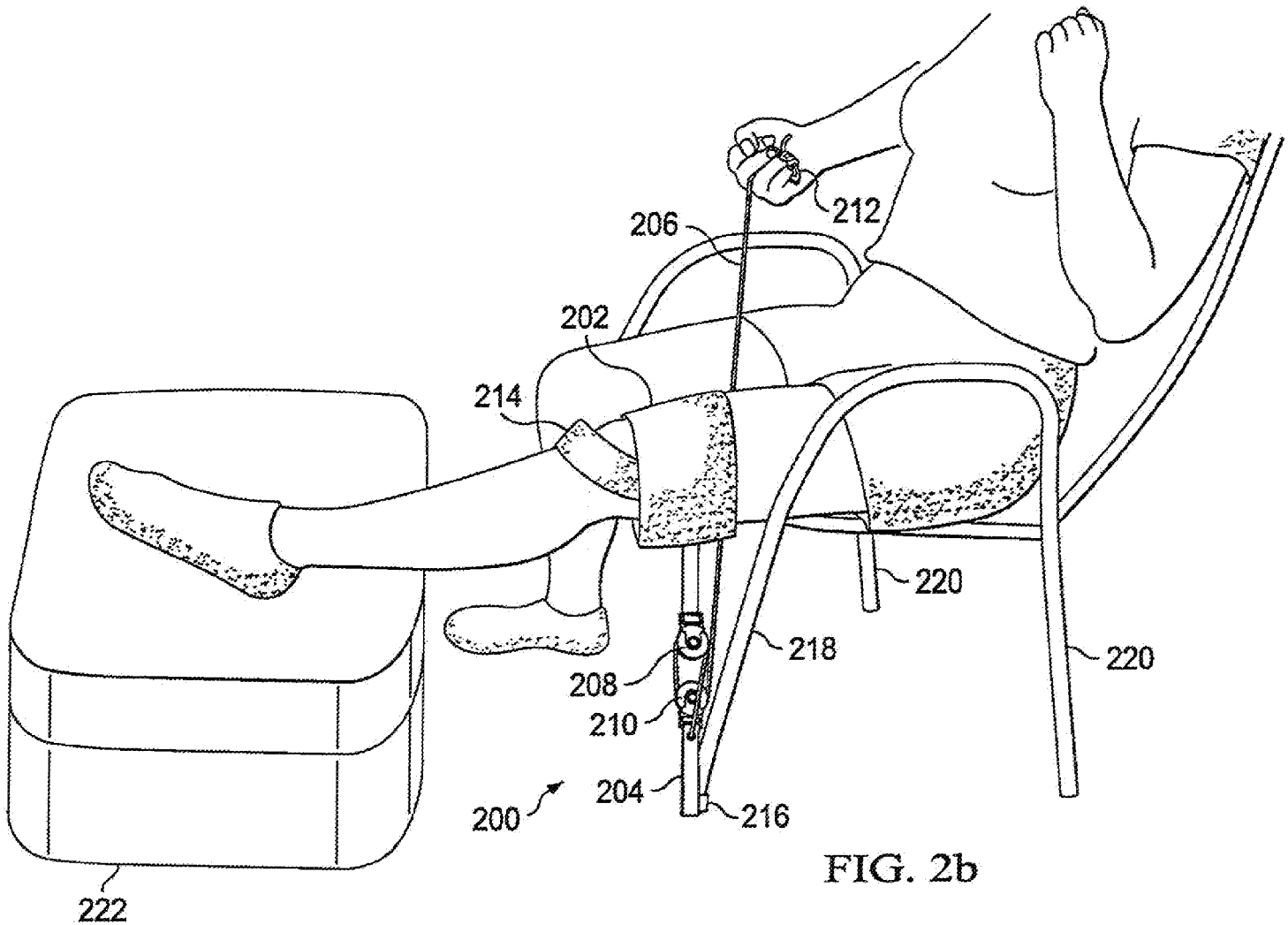
FIG. 2*b* is an exemplary illustration of the portable leg exerciser and mobility enhancement system shown in FIG. 1 employed to perform extension exercise in accordance with one embodiment of the present disclosure, wherein such system is in the engaged position.

FIG. 2*b* is an exemplary illustration of portable leg exerciser and mobility enhancement system 200 employed to perform extension exercise according to one embodiment of the present disclosure, wherein the system is in the engaged position. System 200 could include leg wrap 202, chair leg anchor 204, and rope 206. It should be understood that system 200 shown in FIG. 2*b* is for illustrative purposes only and that any other suitable system or subsystem could be used in conjunction with or in lieu of system 200 according to one embodiment of the present disclosure.

In one embodiment, leg wrap 202 and chair leg anchor 204 could generally be configured as described in FIG. 2*a* above. Rope 206 could be pulled until the bent leg described in FIG. 2*a* is extended to the desired position to create the engaged position of extension exercise.

Figure 3A:
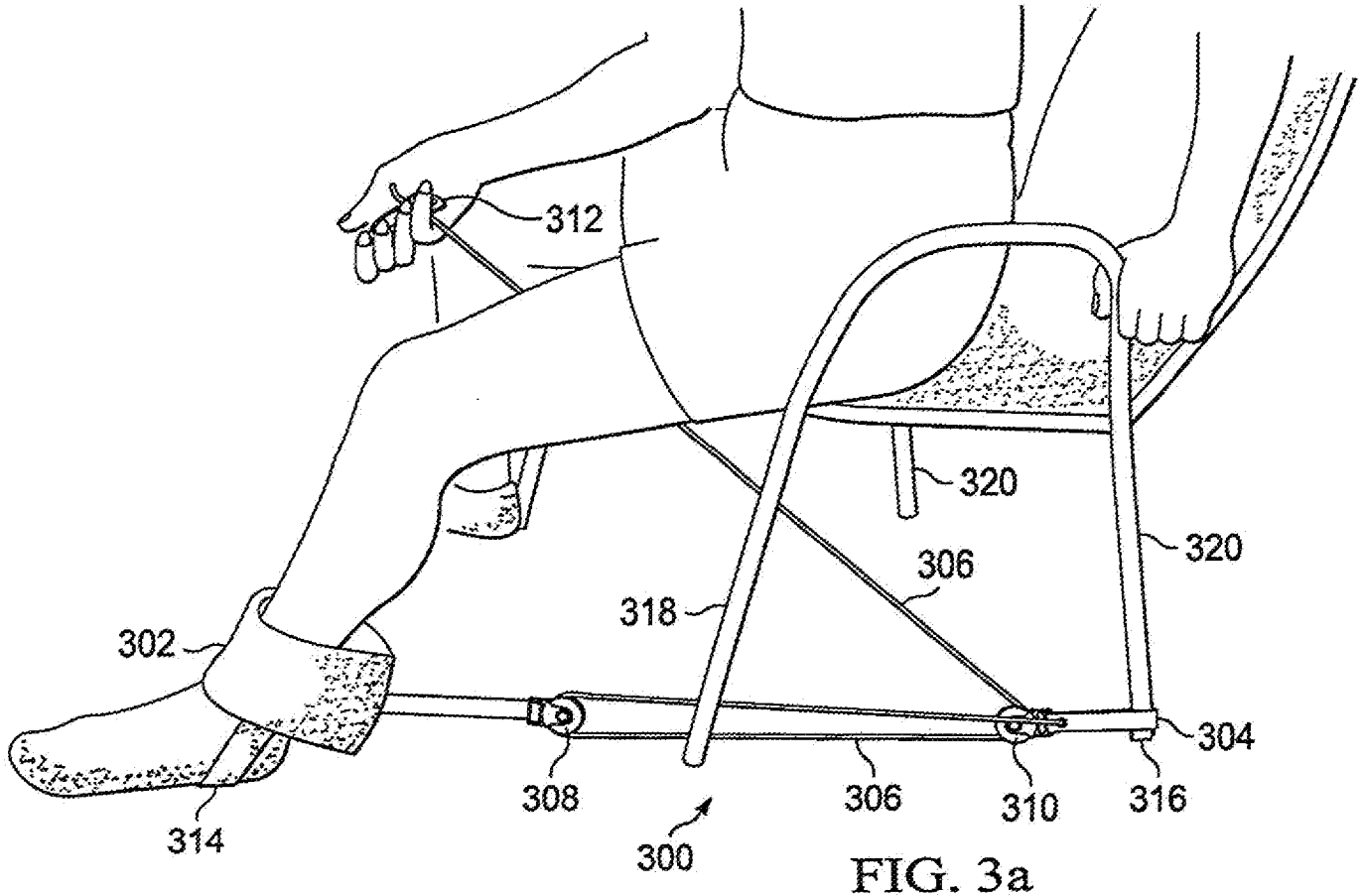
FIG. 3*a* is an exemplary illustration of the portable leg exerciser and mobility enhancement system shown in FIG. 1 employed to perform flexion exercise in accordance with one embodiment of the present disclosure, wherein such system is in the disengaged position.

FIG. 3*a* is an exemplary illustration of portable leg exerciser and mobility enhancement system 300 employed to perform flexion exercise according to one embodiment of the present disclosure, wherein the system is in the disengaged position. System 300 could include leg wrap 302, chair leg anchor 304 and rope 306. It should be understood that system 300 shown in FIG. 3*a* is for illustrative purposes only and that any other suitable system or subsystem could be used in conjunction with or in lieu of system 300 according to one embodiment of the present disclosure.

In one embodiment, system 300 could be similar to system 100 shown in and described, in conjunction with the description accompanying FIG. 1 above (with like parts having similar numbers).

In one embodiment, chair leg anchor 304 could generally be configured to be placed under one of the back legs 320 of a chair corresponding to the leg that needs to be exercised. Leg wrap 302 could be configured to securely fit directly above the appropriate ankle, while the leg is bent at the knee and the foot is rested on the floor. Rope 306 could be held to create the disengaged position of flexion exercise.

Figure 3B:
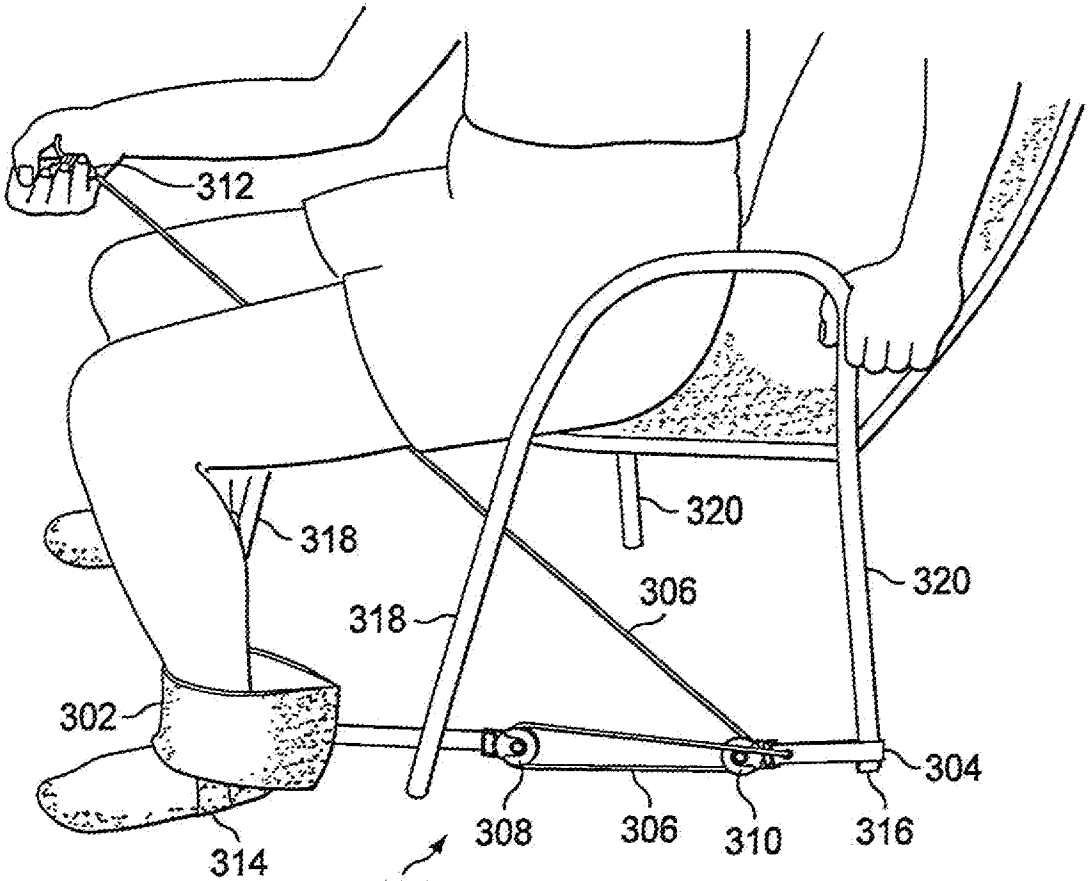
FIG. 3*b* is an exemplary illustration of the portable leg exerciser and mobility enhancement system shown in FIG. 1 employed to perform flexion exercise in accordance with one embodiment of the present disclosure, wherein such system is in the engaged position.

FIG. 3*b* is an exemplary illustration of portable leg exerciser and mobility enhancement system 300 employed to perform flexion exercise according to one embodiment of the present disclosure, wherein the system is in the engaged position. System 300 could include leg wrap 302, chair leg anchor 304 and rope 306. It should be understood that system 300 shown in FIG. 3*b* is for illustrative purposes only and that any other suitable system or subsystem could be used in conjunction with or in lieu of system 300 according to one embodiment of the present disclosure.

In one embodiment, leg wrap 302 and chair leg anchor 304 could generally be configured as described in FIG. 3*a* above. Rope 306 could be pulled up and away from the user's body until the heel of the bent leg described in FIG. 3*a* is pulled towards the rear of the chair to the desired position to create the engaged position of flexion exercise.

Figure 4:
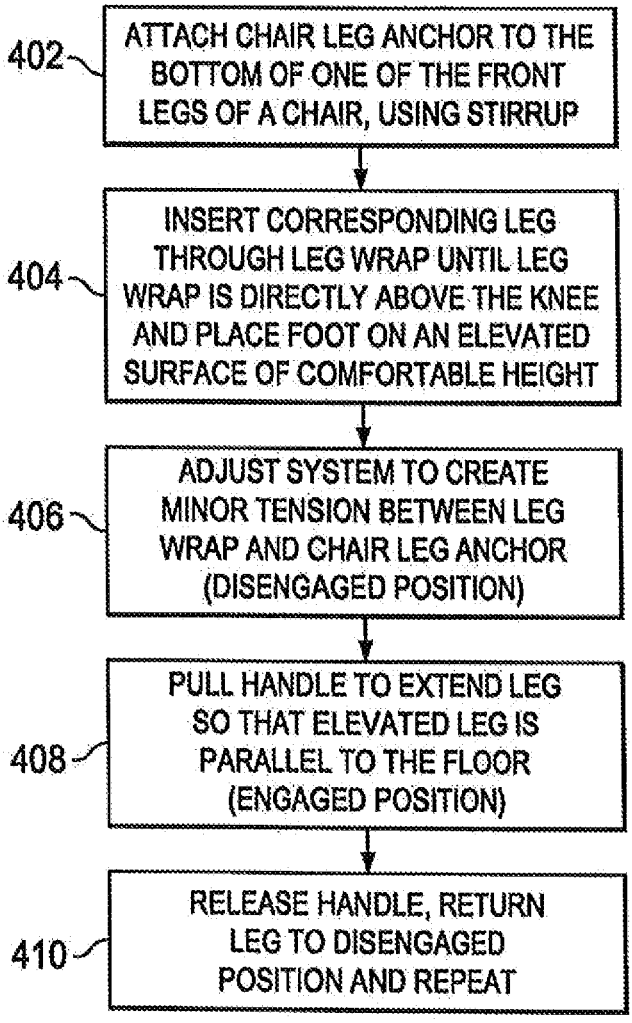
FIG. 4 is a somewhat simplified flow diagram illustrating a method of using a portable leg exerciser and mobility enhancement system as employed to perform extension exercise in accordance with one embodiment of the present disclosure.

FIG. 4 is a somewhat simplified flow diagram illustrating method 400 of using a portable leg exerciser and mobility enhancement system to perform extension exercise according to one embodiment of the present disclosure. It should be understood that method 400 shown in FIG. 4 is for illustrative purposes only and that any other suitable method or submethod could be used in conjunction with or in lieu of method 400 according to one embodiment of the present disclosure. It should also be understood that the steps of method 400 could be performed in any suitable order or manner.

In one embodiment, step 402 could include a user of a portable leg exerciser and mobility enhancement system such as, for example, system 100 shown and described above in FIG. 1, attaching a chair leg anchor, such as, for example, chair leg anchor 104 described above in FIG. 1 to one of the front legs 218 of a chair, such as one described in FIG. 2*a*. The chair could be placed on a stirrup, such as, for example, chair leg stirrup 116 shown and described in FIG. 1 to ensure chair leg anchor 104 stays positioned as desired.

In step 404, the user inserts the corresponding leg through a leg wrap, such as, for example, leg wrap 102 shown and described above in FIG. 1, until leg wrap 102 is directly above the knee, while a leg stirrup, such as, for example, leg stirrup 114 also shown and described in FIG. 1 is directly below the knee. The user then bends the corresponding knee and places that foot on an elevated surface of comfortable height.

In step 406, the user adjusts the system by pulling on a rope, such as, for example rope 106 causing a minor tension between leg wrap 102 and chair leg anchor 104 to create the disengaged position.

In order to proceed to the engaged position of extension exercise, the user pulls rope 106 using a handle, such as, for example, handle 112 shown and described in FIG. 1 to extend the elevated leg to a position that is closer to being parallel to the floor. The user can then choose to release tension using handle 112, thereby returning to the disengaged position, and subsequently repeat the exercise, as desired.

Figure 5:
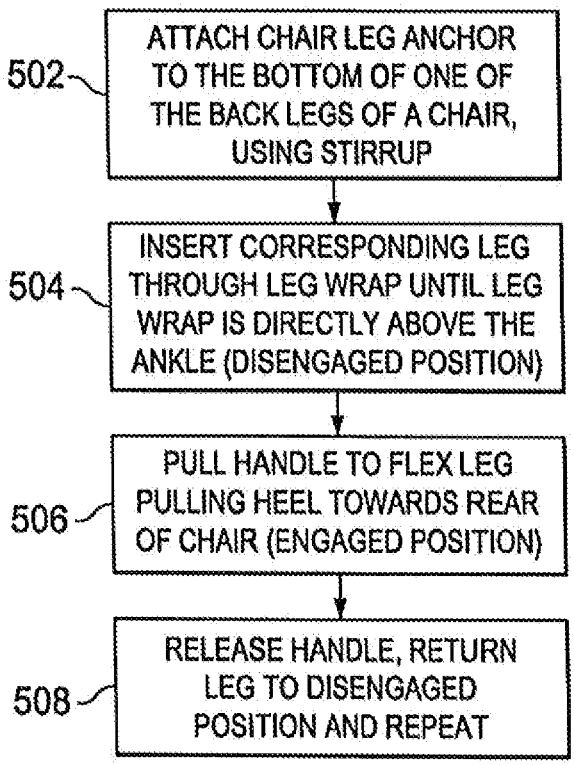
FIG. 5 is a somewhat simplified flow diagram illustrating a method of using a portable leg exerciser and mobility enhancement system as employed to perform flexion exercise in accordance with one embodiment of the present disclosure.

FIG. 5 is a somewhat simplified flow diagram illustrating method 500 of using a portable leg exerciser and mobility enhancement system to perform flexion exercise according to one embodiment of the present disclosure. It should be understood that method 500 shown in FIG. 5 is for illustrative purposes only and that any other suitable method or sub-method could be used in conjunction with or in lieu of method 500 according to one embodiment of the present disclosure. It should also be understood that the steps of method 500 could be performed in any suitable order or manner.

In one embodiment, step 502 could include a user of a portable leg exerciser and mobility enhancement system such as, for example, system 100 shown and described above in FIG. 1, attaching a chair leg anchor, such as, for example, chair leg anchor 104 described above in FIG. 1 to one of the back legs 320 of a chair, such as one described in FIG. 3*a*. The chair could be placed on a stirrup, such as, for example, chair leg stirrup 116 also shown and described in FIG. 1 to ensure chair leg anchor 104 stays positioned as desired.

In step 504, the user inserts the corresponding leg through a leg wrap, such as, for example, leg wrap 102 shown and described above in FIG. 1, until leg wrap 102 is directly above the ankle. The user then bends the corresponding knee and places that foot on the floor on top of a leg stirrup, such as, for example, leg stirrup 114 also shown and described in FIG. 1 to create the disengaged position.

In order to proceed to the engaged position of flexion exercise, the user pulls a rope, such as, for example, rope 106 shown and described in FIG. 1 using a handle, such as, for example, handle 112 also shown and described in FIG. 1 to flex the leg and pull the heel back towards the rear of the chair. The user can choose to release tension using handle 112, thereby returning to the disengaged position, and subsequently repeat the exercise, as desired.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method of using a portable leg exerciser and mobility enhancement system for leg extension, the method comprising:

attaching a chair leg anchor to a front leg of a chair;

attaching a leg wrap to a leg of a user on or near the user's knee;

elevating the user's leg by placing a corresponding foot of the user on an elevated surface;

applying a downward force to the user's leg by pulling a first end of a rope threaded from a second end secured to the chair leg anchor through a movable pulley coupled to the leg wrap and through a stationary pulley coupled to the chair leg anchor; and decreasing the downward force to the user's leg by at least partially releasing the first end of the rope.

2. The method of using a portable leg exerciser and mobility enhancement system for leg extension of claim 1, wherein the step of attaching a leg wrap to a leg of a user on or near the user's knee further comprises attaching the leg wrap on a selected side of the user that corresponds to a side of the chair to which the chair leg anchor is attached.

3. A method of using a portable leg exerciser and mobility enhancement system for leg flexion, the method comprising:

attaching a chair leg anchor to a rear leg of a chair;

attaching a leg wrap to a leg of a user on or near the user's ankle;

applying a rearward force to the user's leg by pulling a first end of a rope threaded from a second end secured to the chair leg anchor through a movable pulley coupled to the leg wrap and through a stationary pulley coupled to the chair leg anchor; and decreasing the rearward force to the user's leg by at least partially releasing the first end of the rope.

4. The method of using a portable leg exerciser and mobility enhancement system for leg flexion of claim 3, wherein the step of attaching a leg wrap to a leg of a user on or near the user's ankle further comprises attaching the leg wrap on a selected side of the user that corresponds to a side of the chair to which the chair leg anchor is attached.

* * * * *